US007580015B2

(12) United States Patent
Tai et al.

(10) Patent No.: US 7,580,015 B2
(45) Date of Patent: Aug. 25, 2009

(54) ACTIVE MATRIX ORGANIC LIGHT EMITTING DIODES PIXEL CIRCUIT

(75) Inventors: Ya-Hsiang Tai, Hsin-Chu (TW); Cheng-Chiu Pai, Chang-Hua Hsien (TW)

(73) Assignee: TPO Displays Corp. (TW)

( * ) Notice: Subject to any disclaimer, the term of this patent is extended or adjusted under 35 U.S.C. 154(b) by 744 days.

(21) Appl. No.: 11/361,634

(22) Filed: Feb. 24, 2006

(65) Prior Publication Data

US 2007/0040769 A1 Feb. 22, 2007

(30) Foreign Application Priority Data

Aug. 19, 2005 (TW) ..... 94128425 A

(51) Int. Cl.
*G09G 3/32* (2006.01)

(52) U.S. Cl. ..... 345/82; 345/76; 345/55; 345/204

(58) Field of Classification Search ..... 345/82, 345/76, 55, 204
See application file for complete search history.

(56) References Cited

U.S. PATENT DOCUMENTS

2004/0066358 A1* 4/2004 Numao ..... 345/76
2005/0212446 A1* 9/2005 Eom ..... 315/169.3
2006/0028408 A1* 2/2006 Kim ..... 345/76
2006/0043527 A1* 3/2006 Kwak ..... 257/532

OTHER PUBLICATIONS

Cheng-Chiu Pai, "Study on the Compensation Circuits of Poly-Si TFTs for Active Matrix Displays", Jun. 2005, p. 41-46 and 54, National Chiao Tung University, Hsincu, Taiwan, Republic of China.

* cited by examiner

*Primary Examiner*—Richard Hjerpe
*Assistant Examiner*—Leonid Shapiro
(74) *Attorney, Agent, or Firm*—Thomas, Kayden, Horstemeyer & Risley, LLP.

(57) ABSTRACT

A pixel circuit of an active-matrix organic light-emitting diode does not provide currents for an organic light-emitting diode during a compensation period, and provides currents, free from variation of a threshold voltage of a thin-film transistor, for the organic light-emitting diode during a data input period, so as to improve gray levels, increase contrast ratios, and decrease power consumption.

6 Claims, 6 Drawing Sheets

ACTIVE MATRIX ORGANIC LIGHT EMITTING DIODES PIXEL CIRCUIT

BACKGROUND OF THE INVENTION

1. Field of the Invention

The present invention provides a pixel circuit of an active-matrix organic light-emitting diode, and more particularly, a pixel circuit capable of compensating property variations in poly-Si TFTs.

2. Description of the Prior Art

Compared to a cathode ray tube (CRT) monitor, a flat panel display (FPD) monitor has incomparable advantages, such as low power consumption, no radiation, small volume, etc., so that the FPD monitor has become a substitute for the CRT monitor. As FPD technology advances, prices of FPD monitors are reduced, and sizes of FPD monitors are increased, which make FPD monitors more popular. Therefore, light, fine, colorful, low-power FPD monitors are expected, and a device that can combine these advantages is the Organic Light-Emitting Diode (OLED) display.

The OLED combines many characteristics together, such as self emission, a wide viewing angle (over 165°), short response time (about 1 μs), high brightness (100-14000 cd/m2), high luminance efficiency (16-38 Im/W), low driving voltage (3-9V DC), thin panel (2 mm), simplified manufacturing, low cost, etc., and the OLED can be applied for large-size or flexible panels. The principle of an OLED is that after conducting a bias voltage, electrons and holes are passing through a hole transport layer, an electron transport layer and then combine in an organic light emitting material to form "excitons". Energy of the excitons is released to the ground state, and the released energy creates luminance of the OLED with colors.

According to different driving methods, the OLED can be divided into two kinds, and one is a passive matrix OLED, or PM-OLED, and the other is an active matrix OLED, or AM-OLED. Please refer to FIG. 1 and FIG. 2. FIG. 1 illustrates a schematic diagram of a PM-OLED of a pixel, while FIG. 2 illustrates a schematic of an AM-OLED of a pixel. In comparison, the structure of the PM-OLED shown in FIG. 1 is simple, so the cost is low. However, the PM-OLED must be operated under highpulse-currents to reach the brightness appropriate for human eyes. Moreover, the brightness of the PM-OLED is directly proportional to the operating current, and the higher the operating current, the lower the circuit efficiency, the life, and the resolution of the PM-OLED. As a result, the PM-OLED is usually utilized for small sized products. On the other hand, although cost and complexity of the AM-OLED are higher than the PM-OLED (but still lower than a TFT-LCD), yet each pixel can store driving signals and can be operated independently and continuously. Also, circuit efficiency of the AM-OLED is higher, so the AM-OLED is utilized for products of large size, high resolution, and high information capacity. However, there are many factors affecting performance of a large size AM-OLED panel.

As those skilled in the art recognize, in FIG. 2, a current $I_{OLED}$ flowing through the OLED can be derived as:

$$I_{OLED} = \frac{1}{2}\mu \cdot C_{OX} \cdot \frac{W}{L} \cdot (V_{GS} - V_{TH})^2$$

Therefore, the current $I_{OLED}$ is affected by the threshold voltage $V_{TH}$ of the polycrystalline silicon thin-film transistor, or poly-Si TFT, as shown in FIG. 2, so that the performance of pixels varies with time and can not reach uniform image. In order to improve the performance, the prior art provides various pixel circuits for compensating the variation in the poly-Si TFT.

In the prior art, pixel circuits of the AM-OLED can be classified into: current driving, digital driving, and voltage driving pixel circuits. A current driving pixel circuit provides excellent image quality, but its panel driving speed is too slow to implement high resolution displays. A digital driving pixel circuit can reduce the poly-Si TFT threshold voltage variation sensitivity, but it needs a very fast addressing speed, so that it is not a good solution for high gray scale displays. A voltage driving pixel circuit can compensate the variation of threshold and is more attractive to integrate poly-Si TFT data drivers on a display panel. However, the prior art voltage driving pixel circuit still has some disadvantages.

For example, please refer to FIG. 3, which illustrates a prior art pixel circuit 30 of an AM-OLED. The pixel circuit 30 comprises an OLED 300, switching transistors 302, 304, 306, a driving transistor 308, capacitors 310, 312, scan-line signal reception ends 316, 318, 320, and a data-line signal reception end 314. The switching transistors 302, 304, 306, and the driving transistor 308 are poly-Si TFTs. The scan-line signal reception ends 316 and 320 receive first scan-line signal for controlling the switching transistors 302 and 306. The scan-line signal reception end 318 receives second scan-line signal for controlling the switching transistor 304. The data-line signal reception end 314 receives data-line signal ($V_{in}$) for driving the driving transistor 308 to output current $I_{OLED}$ to the OLED 300 and emit light at specific durations. In addition, according to characteristics of the OLED 300, the OLED 300 can be considered to be a transistor and a capacitor as an equivalent circuit 400 shown in FIG. 4. The equivalent circuit 400 includes a transistor 402 and a capacitor 404. A gate of the transistor 402 is coupled to a drain of the transistor 402, and the capacitor 404 is coupled between the drain and a source of the transistor 402.

Please refer to FIG. 5, which illustrates a time sequential signal waveform of the data line, the first scan line, and the second scan line. In FIG. 5, durations T1, T2, and T3 are an initialization period, a compensation period, and a data-input period respectively. Referring to FIG. 3 and FIG. 5, in the duration T1, the data-line signal are at a low voltage level, and the first scan-line signal and the second scan-line signal are at a high voltage level, so the switching transistors 302, 304, 306 are turned on. Then, electrons stored in a gate G and a source S of the driving transistor 308 flow through the switching transistors 302, 304, and 306 to the data-line signal reception end 314. Next, in the duration T2, the first scan-line signal stay at the high voltage level, the second scan-line signal change to the low voltage level, and the data-line signal change to the high voltage level, so the switching transistor 304 is tuned off. Then, the data-line signal is input to the gate G of the driving transistor 308 through the switching transistor 302. Since the data-line signal is at the high voltage level ($V_{in}$) in this case, a current flow generated from the drain D to the source S of the driving transistor 308 to the OLED 300. Meanwhile, the high-level data-line signal charges the capacitor 312, so that the capacitor 312 stores a voltage drop ΔV:

$$\Delta V = \frac{a}{1+a} \times V_{TH_T_{DV}} - \frac{1}{1+a} \times V_{TH_OLED} + \frac{1}{1+a} \times V_{in}$$

where, $$a = \sqrt{\frac{K_{T_{DV}}}{K_{T_{OLED}}}},$$

$K_{T_{DV}}$ and $K_{T_{OLED}}$ are conduction parameters of the driving transistor 308 and the OLED 300 respectively, $V_{TH_T_{DV}}$ and $V_{TH_OLED}$ are threshold voltages of the driving transistor 308 and the OLED 300 respectively.

Next, in the duration T3, the data-line signal stay at the high voltage level, the first scan-line signal change to the low voltage level, and the second scan-line signal change to the high voltage level, so the driving transistor 308 stays on, the switching transistors 302, and 306 are turned off, and the switching transistor 304 is turned on. Therefore, data-line signals ($V_{in}$) charge the capacitor 312 through the switching transistor 304, and the gate voltage of the driving transistor 308 becomes $V_{in}+\Delta V$. If an output (source) voltage of the driving transistor 308 is $V_{out}$, then a current $I_{OLED}$ flowing into the OLED 300 is:

$$I_{OLED}=K_{T_{DV}}\cdot(V_{GS}-V_{TH_T_{DV}})^2=K_{T_{DV}}\cdot(V_{in}+\Delta V-V_{out}-V_{TH_T_{DV}})^2$$

Therefore, the current flowing into the OLED 300 is changed with the voltage drop ΔV stored in the capacitor 312, where the voltage drop ΔV is varied with the threshold voltage. As a result, the current flowing into the OLED 300 is varied unexpectedly, causing non-uniformity of images between pixels and degradation of display quality.

In short, during the compensation period, the prior art pixel circuit 30 provides an unnecessary current to the OLED 300, and during the data-input period, the current flowing into the OLED 300 is affected by the threshold voltage, causing a bad gray level, a low contrast, and an increasing power consumption of the display panel.

SUMMARY OF THE INVENTION

It is therefore a primary objective of the claimed invention to provide a pixel circuit of an active-matrix organic light-emitting diode.

The present invention discloses a pixel circuit of an active-matrix organic light-emitting diode. The pixel circuit comprises a first switching transistor, a second switching transistor, a third switching transistor, a driving transistor, a first capacitor, a second capacitor, and a fourth switching transistor. The first switching transistor comprises a first electrode coupled to a data line, a second electrode coupled to a first scan line, and a third electrode. The second switching transistor comprises a first electrode coupled to the data line, a second electrode coupled to a second scan line, and a third electrode. The third switching transistor comprises a first electrode coupled to the third electrode of the second switching transistor, a second electrode coupled to the first scan line, and a third electrode. The driving transistor comprises a first electrode coupled to a first voltage, a second electrode coupled to the third electrode of the first switching transistor, and a third electrode coupled to third electrode of the third switching transistor. The first capacitor comprises one end coupled to the first electrode of the driving transistor and the third electrode of the second switching transistor, and the other end coupled to the first electrode of the third switching transistor. The second capacitor comprises one end coupled to the third electrode of the first switching transistor and the second electrode of the driving transistor, and the other end coupled to the third electrode of the second switching transistor and the first electrode of the third switching transistor. The fourth switching transistor comprises a first electrode coupled to the third electrode of the third switching transistor and the third electrode of the driving transistor, a second electrode coupled to the first scan line, and a third electrode coupled to an organic light-emitting diode.

The present invention further discloses a method for driving the above-mentioned pixel circuit. The method comprises during an initialization period, adjusting voltage levels of the first scan line and the second scan line to a first voltage, and adjusting a voltage level of the data line to a second voltage; during a compensation period, adjusting the voltage levels of the data line and the first scan line to the first voltage, and adjusting the voltage level of the second scan line to the second voltage; and during a data-input period, adjusting the voltage levels of the data line and the second scan line to the first voltage, and adjusting the voltage level of the first scan line to the second voltage.

These and other objectives of the present invention will no doubt become obvious to those of ordinary skill in the art after reading the following detailed description of the preferred embodiment that is illustrated in the various figures and drawings.

DETAILED DESCRIPTION OF THE INVENTION

Figure 6:
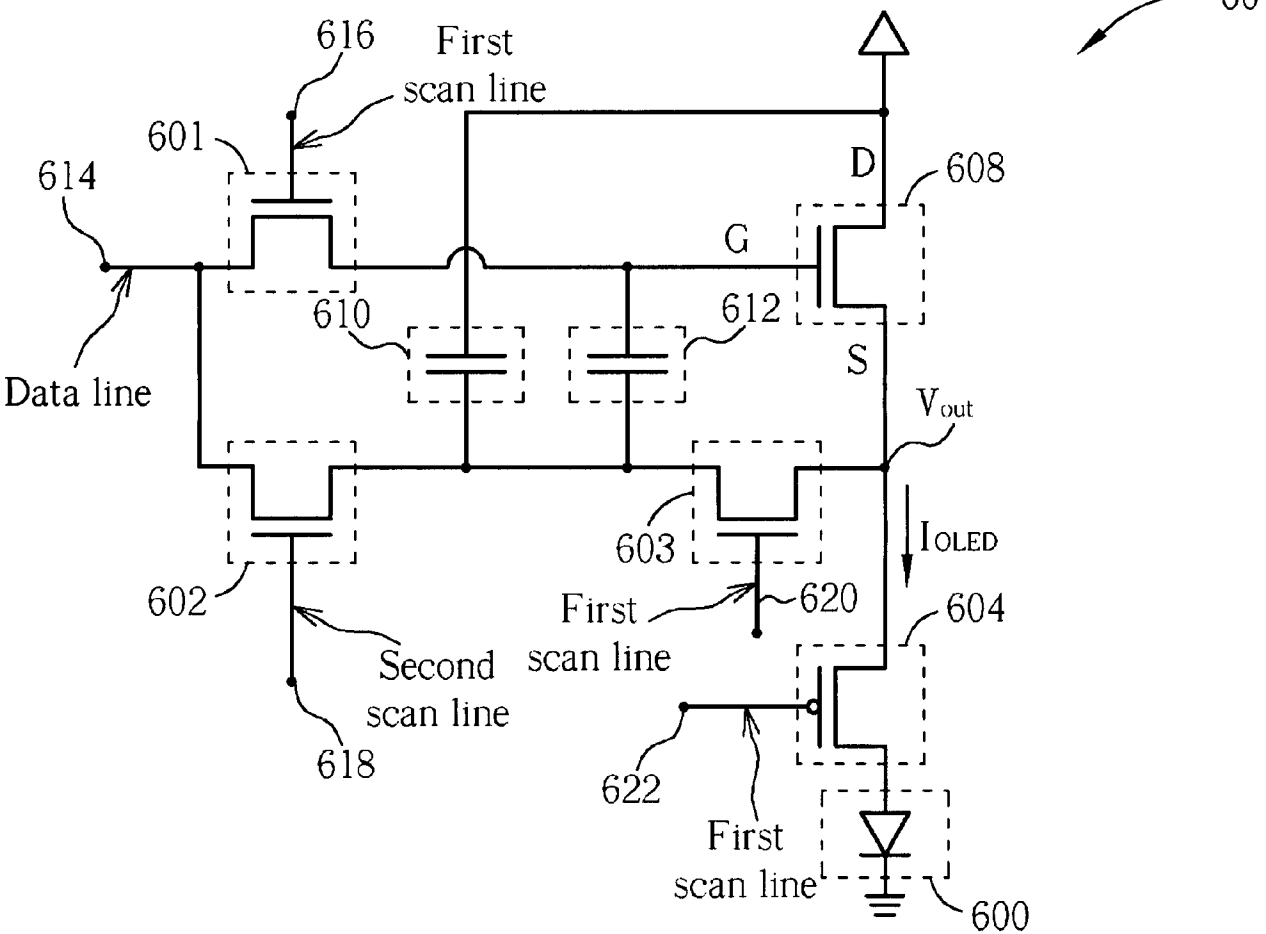
FIG. 6 illustrates a schematic diagram of a pixel circuit of an AM-OLED in accordance with the present invention.

Please refer to FIG. 6, which illustrates a schematic diagram of a pixel circuit 60 of an AM-OLED in accordance with the present invention. The pixel circuit 60 comprises an OLED 600, switching transistors 601, 602, 603, 604, a driving transistor 608, capacitors 610, 612, scan-line signal reception ends 616, 618, 620, 622, and a data-line signal reception end 614. The switching transistors 601, 602, 603, 604, and the driving transistor 608 are poly-Si TFTs. Notice that a polarity of the switching transistor 604 is opposite to polarities of the switching transistors 601, 602, 603, and the driving transistor 608 (in an embodiment, the switching transistors 601, 602, 603, and the driving transistor 608 are n-type, while the switching transistor 604 is p-type). The capacitor 610 sustains a gate voltage of the driving transistor 608 against leakage currents. The capacitor 612 stores a threshold voltage of the driving transistor 608 (which will be detailed). The scan-line signal reception ends 616, 620, and 622 receive a first scan-line signal for controlling the switching transistors 601, 603, and 604. The scan-line signal reception end 618 receives a second scan-line signal for controlling the switching transistor 602. The data-line signal reception end 614 receive data-line signal ($V_{in}$) for driving the driving transistor 608 to output current $I_{OLED}$ to the OLED 600 at specific durations.

Figure 1:
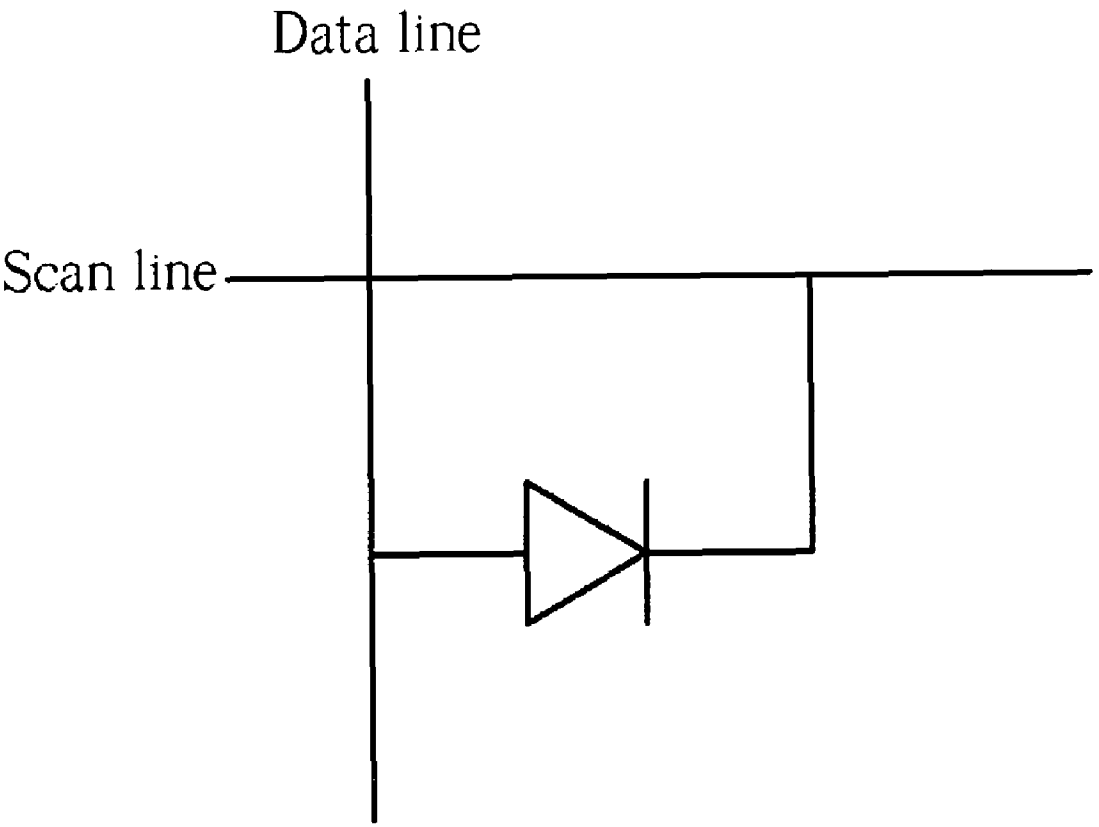
Fig.1 Prior art
FIG. 1 illustrates a schematic diagram of a prior art PM-OLED pixel circuit.
Figure 2:
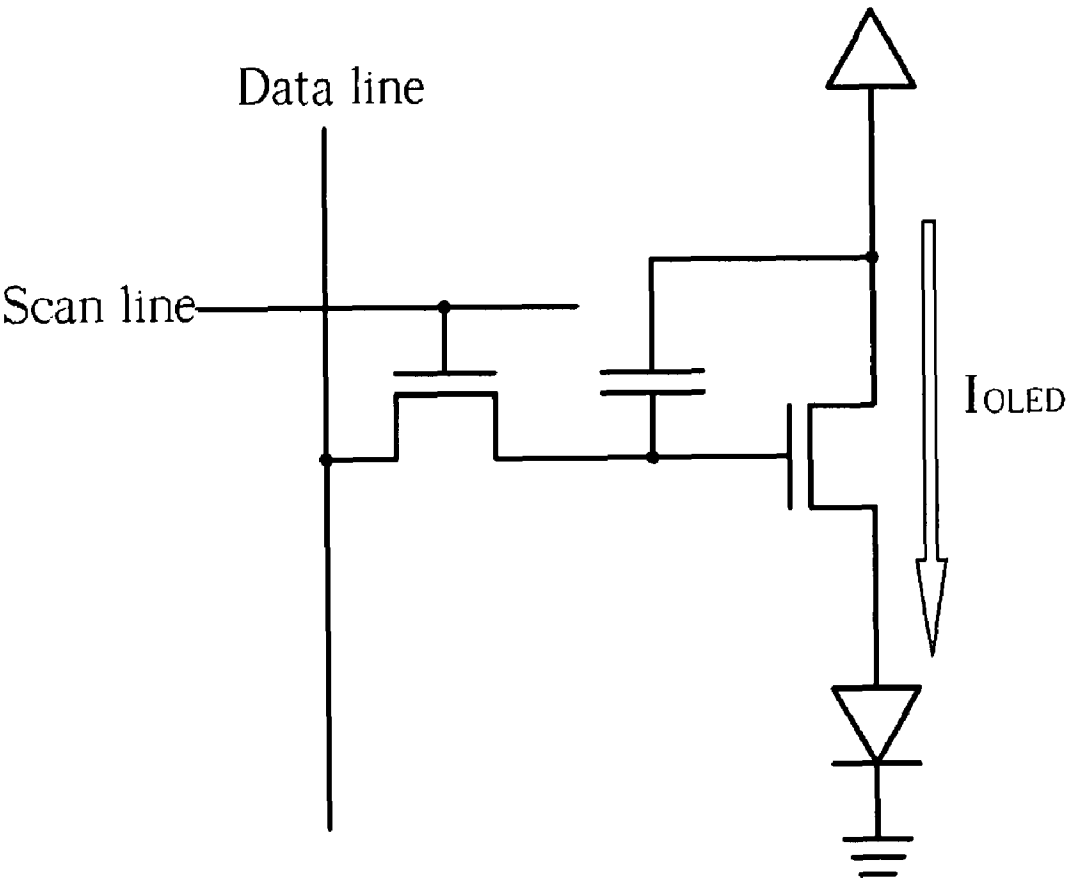
Fig.2 Prior art
FIG. 2 illustrates a schematic of a prior art AM-OLED pixel circuit.
Figure 3:
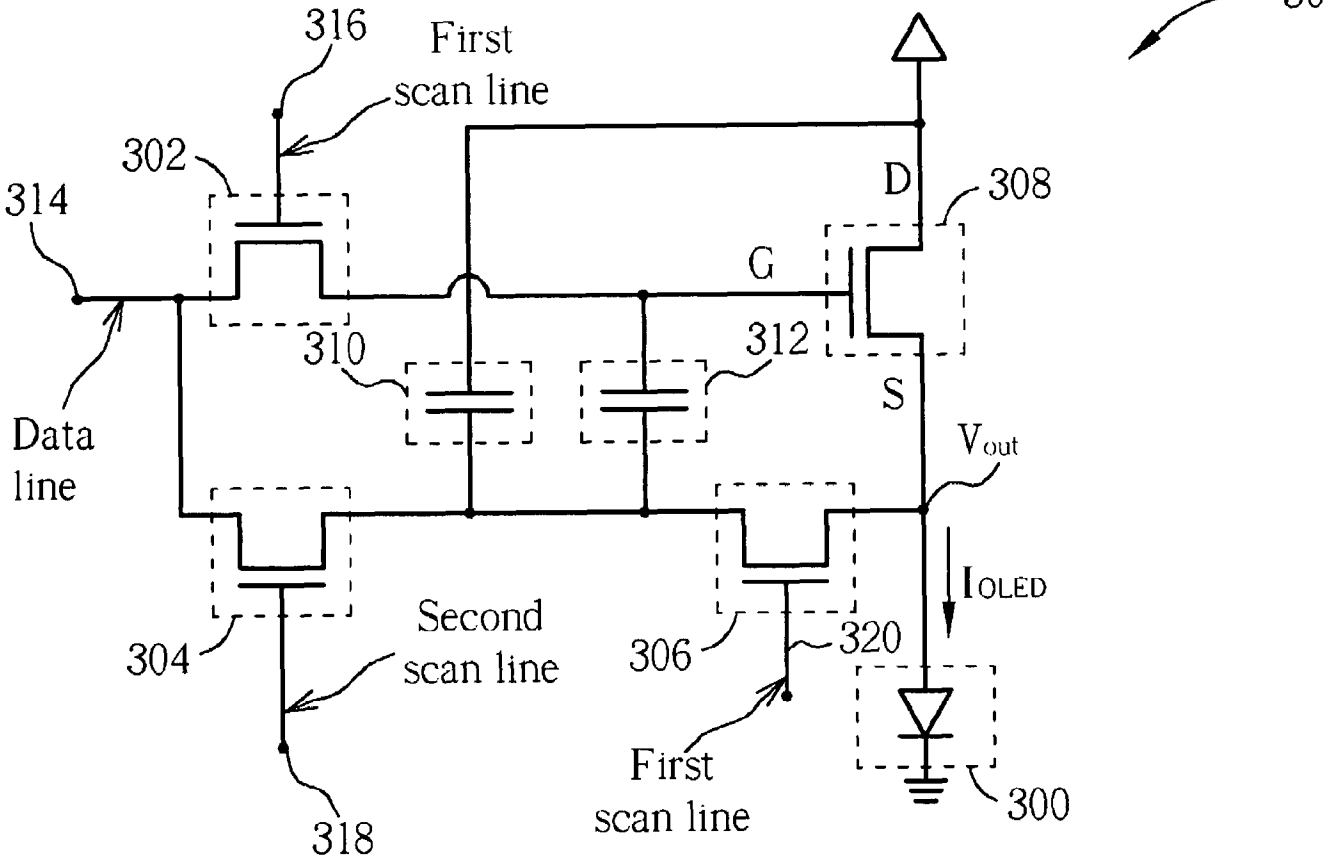
Fig.3 Prior art
FIG. 3 illustrates a schematic of a prior art AMOLED pixel circuit.
Figure 4:
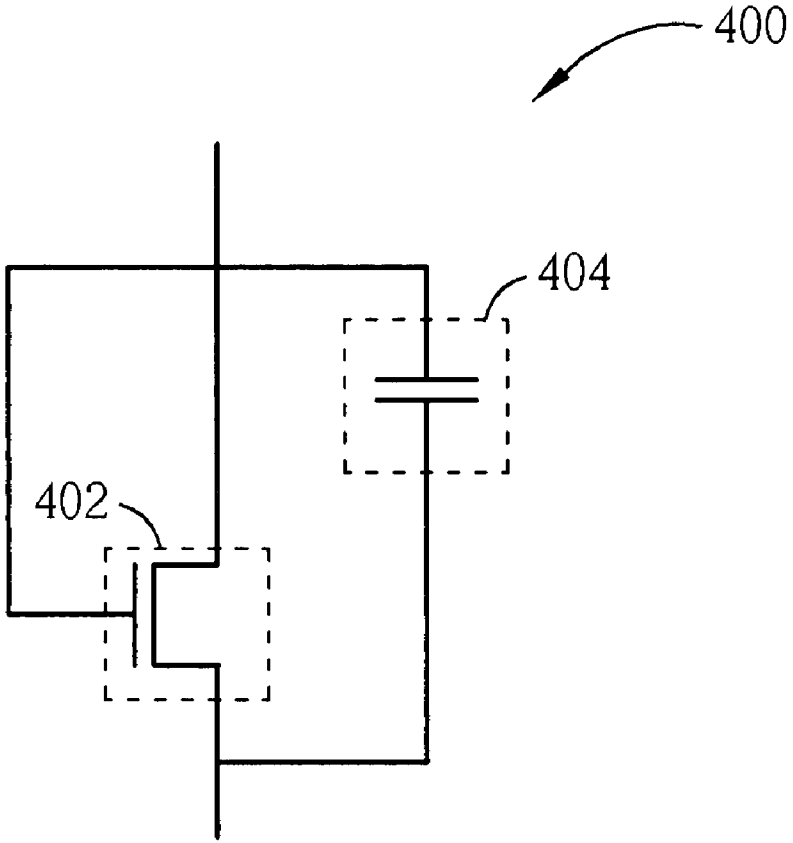
Fig.4 Prior art
FIG. 4 illustrates an equivalent circuit of an OLED.
Figure 5:
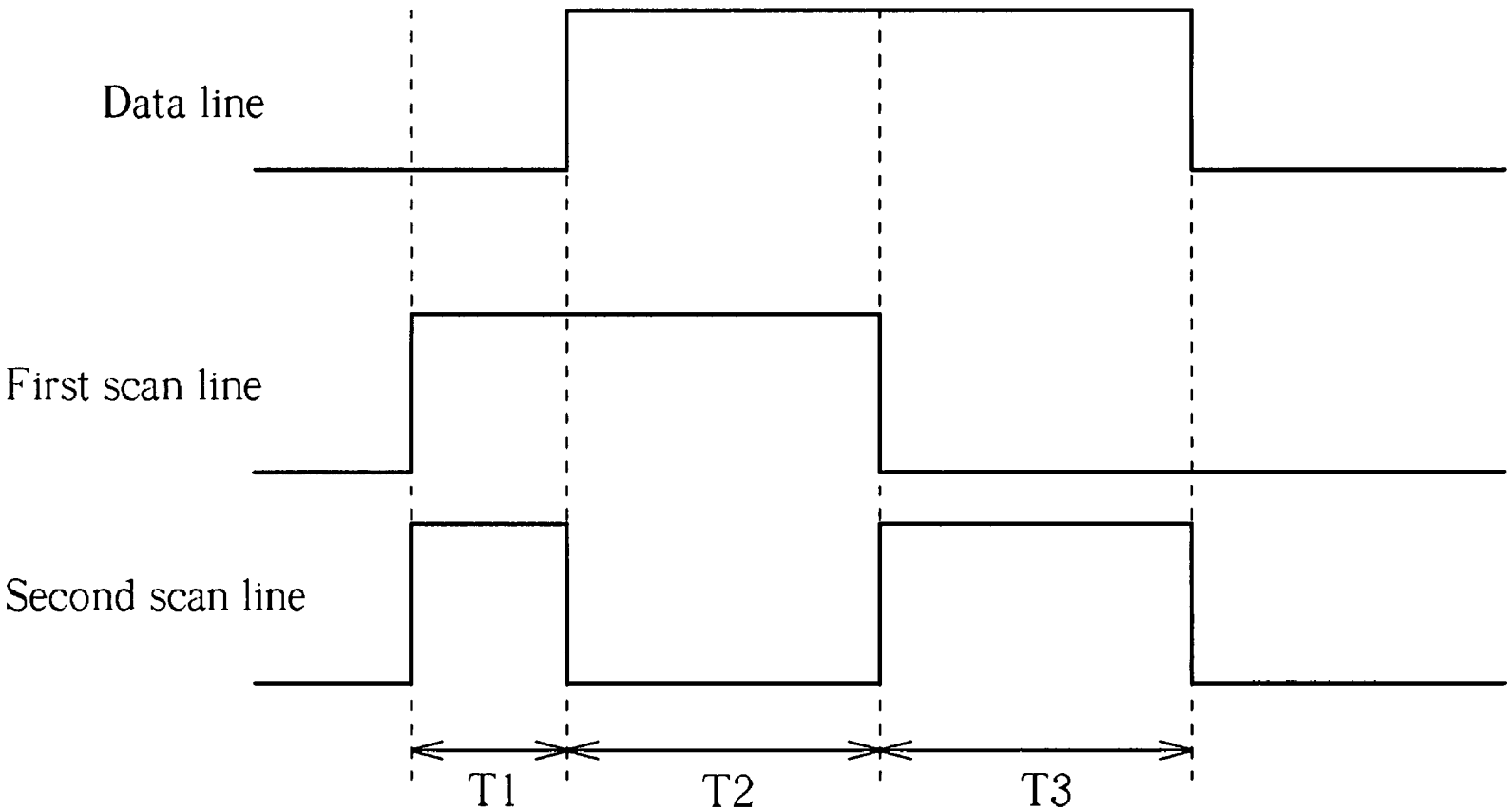
Fig.5 Prior art
FIG. 5 illustrates a time sequential signal waveform of a data line, a first scan line, and a second scan line in FIG. 3 and FIG. 6.

The pixel circuit 60 is operated according to the time sequential signal waveform shown in FIG. 5. Referring to FIG. 6 and FIG. 5, in the duration T1, the data-line signal are at a low voltage level, and the first scan-line signal and the second scan-line signal are at a high voltage level, so the switching transistors 601, 602, and 603 are turned on, and the switching transistor 604 is turned off. Then, electrons stored in a gate G and a source S of the driving transistor 608 flow through the switching transistors 601, 602, and 603 to the data-line signal reception end 614. Next, in the duration T2, the first scan-line signal stay at the high voltage level, the second scan-line signal change to the low voltage level, and the data-line signal change to the high voltage level, so the switching transistors 601, 603 stay on, and the switching transistor 602 is turned off. Then, the data-line signal input to the gate G of the driving transistor 608 through the switching transistor 601, so as to drive the driving transistor 608 and charge the capacitor 612. Meanwhile, since the switching transistor 604 is still off, a source current of the driving transistor 608 does not flow into the OLED 600, but flows into the capacitors 610 and 612 through the switching transistor 603. As a result, the capacitor 612 stores a voltage drop ΔV equaling to a threshold voltage of the driving transistor 608. That is, $$\Delta V = V_{TH_T_{DV}}$$

where, $V_{T_T_{DV}}$ is the threshold voltage of the driving transistor 608. Therefore, during the compensation period, the present invention pixel circuit 60 does not output current to the OLED 600.

Next, in the duration T3, the data-line signal stay at the high voltage level, the first scan-line signal change to the low voltage level, and the second scan-line signal change to the high voltage level, so the switching transistors 601 and 603 are turned off, the switching transistors 602 and 604 are turned on. Then, data-line signal ($V_{in}$) charge the capacitor 612 through the switching transistor 602, and a gate voltage $V_G$ of the driving transistor 608 becomes:

$$V_G = V_{in} + V_{TH_T_{DV}}$$

If an output (source) voltage of the driving transistor 608 is $V_{out}$, then a current $I_{OLED}$ flowing into the OLED 600 is:

$$I_{OLED} = K_{T_{DV}} \cdot (V_{GS} - V_{TH_T_{DV}})^2 = K_{T_{DV}} \cdot (V_{in} + V_{TH_T_{DV}} - V_{out} - V_{TH_T_{DV}})^2 = K_{T_{DV}} \cdot (V_{in} - V_{out})^2.$$

Therefore, the current flowing into the OLED 600 is not affected by the threshold voltage of the driving transistor 608, so as to improve a gray level, increase a contrast ratio, and decrease power consumption.

In comparison, during the compensation period, the prior art pixel circuit provides an unnecessary current to the OLED, and during the data-input period, the current flowing into the OLED is affected by the threshold voltage. On the other hand, during the compensation period, the present invention pixel circuit does not provide current to the OLED, and during the data-input period, the current flowing into the OLED is not affected by the threshold voltage, so as to improve a gray level, increase a contrast ratio, and decrease power consumption.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel circuit of an active-matrix organic light-emitting diode comprising:

a first switching transistor comprising a first electrode coupled to a data line, a second electrode coupled to a first scan line, and a third electrode;

a second switching transistor comprising a first electrode coupled to the data line, a second electrode coupled to a second scan line, and a third electrode;

a third switching transistor comprising a first electrode coupled to the third electrode of the second switching transistor, a second electrode coupled to the first scan line, and a third electrode;

a driving transistor comprising a first electrode coupled to a first voltage, a second electrode coupled to the third electrode of the first switching transistor, and a third electrode coupled to third electrode of the third switching transistor;

a first capacitor comprising one end coupled to the first electrode of the driving transistor and the third electrode of the second switching transistor, and the other end coupled to the first electrode of the third switching transistor;

a second capacitor comprising one end coupled to the third electrode of the first switching transistor and the second electrode of the driving transistor, and the other end coupled to the third electrode of the second switching transistor and the first electrode of the third switching transistor; and a fourth switching transistor comprising a first electrode coupled to the third electrode of the third switching transistor and the third electrode of the driving transistor, a second electrode coupled to the first scan line, and a third electrode coupled to an organic light-emitting diode.

2. The pixel circuit of claim 1, wherein the first switching transistor, the second switching transistor, the third switching transistor, and the driving transistor are n-type polycrystalline silicon thin-film transistors, and the fourth switching transistor is a p-type polycrystalline silicon thin-film transistor.

3. A method for driving a pixel circuit of an active-matrix organic light-emitting diode, the pixel circuit comprising:

a first switching transistor comprising a first electrode coupled to a data line, a second electrode coupled to a first scan line, and a third electrode;

a second switching transistor comprising a first electrode coupled to the data line, a second electrode coupled to a second scan line, and a third electrode;

a third switching transistor comprising a first electrode coupled to the third electrode of the second switching transistor, a second electrode coupled to the first scan line, and a third electrode;

a driving transistor comprising a first electrode coupled to a first voltage, a second electrode coupled to the third electrode of the first switching transistor, and a third electrode coupled to third electrode of the third switching transistor;

a first capacitor comprising one end coupled to the first electrode of the driving transistor and the third electrode of the second switching transistor, and the other end coupled to the first electrode of the third switching transistor;

a second capacitor comprising one end coupled to the third electrode of the first switching transistor and the second electrode of the driving transistor, and the other end coupled to the third electrode of the second switching transistor and the first electrode of the third switching transistor; and a fourth switching transistor comprising a first electrode coupled to the third electrode of the third switching transistor and the third electrode of the driving transistor, a second electrode coupled to the first scan line, and a third electrode coupled to an organic light-emitting diode;

the method comprising:

during an initialization period, adjusting voltage levels of the first scan line and the second scan line to a first voltage, and adjusting a voltage level of the data line to a second voltage;

during a compensation period, adjusting the voltage levels of the data line and the first scan line to the first voltage, and adjusting the voltage level of the second scan line to the second voltage; and during a data-input period, adjusting the voltage levels of the data line and the second scan line to the first voltage, and adjusting the voltage level of the first scan line to the second voltage.

4. The method of claim 3, wherein in a frame cycle, the initialization period leads the compensation period, and the compensation period leads the data-input period.

5. The method of claim 3, wherein a value of the first voltage is greater than 0.

6. The method of claim 3, wherein a value of the second voltage is 0.

* * * * *